US005177948A

United States Patent [19]

Kolmes et al.

[11] Patent Number: 5,177,948

[45] Date of Patent: * Jan. 12, 1993

[54] YARN AND GLOVE

[76] Inventors: Nathaniel H. Kolmes, 1740 5th Street Dr., NW., Hickory, N.C. 28601; Harold F. Plemmons, Rte. #1, Box #628, Millers Creek, N.C. 28651

[ * ] Notice: The portion of the term of this patent subsequent to Jun. 26, 2007 has been disclaimed.

[21] Appl. No.: 823,088

[22] Filed: Jan. 15, 1992

Related U.S. Application Data

[63] Continuation of Ser. No. 487,040, Mar. 2, 1990, abandoned, which is a continuation-in-part of Ser. No. 366,885, Jun. 13, 1989, Pat. No. 4,936,085.

[51] Int. Cl.[5] ..... D02G 3/18; D02G 3/38

[52] U.S. Cl. ..... 57/229; 57/230

[58] Field of Search ..... 57/210, 229, 230, 231, 57/232, 235, 902

[56] References Cited

U.S. PATENT DOCUMENTS

| | | | |
|---|---|---|---|
| 2,335,644 | 11/1943 | Camp | 57/234 X |
| 2,573,361 | 10/1951 | Rodgers et al. | 57/229 X |
| 3,490,224 | 1/1970 | Bourgeas | 57/244 X |
| 4,321,854 | 3/1982 | Foote et al. | 57/210 X |
| 4,384,449 | 5/1983 | Byrnes et al. | 57/210 |
| 4,470,251 | 9/1984 | Bettcher | 57/210 X |
| 4,777,789 | 10/1988 | Kolmes et al. | 57/210 |
| 4,838,017 | 6/1989 | Kolmes et al. | 57/210 |
| 4,936,085 | 6/1990 | Kolmes et al. | 57/229 |
| 4,967,548 | 11/1990 | Fangeat et al. | 57/229 X |

*Primary Examiner*—Joseph J. Hail, III

*Attorney, Agent, or Firm*—Rhodes, Coats & Bennett

[57] ABSTRACT

An improved non-metallic yarn, fabric and protective garment made from such yarn, where the yarn, fabric and garment exhibit increased cut resistance, flexibility, pliability and softness. The yarn is non-metallic and includes a core made of fiber and a covering wrapped around the core. At least one of the strands of the core is fiberglass, the non-fiberglass strands are preferably nylon, extended chain polyethylene, aramid or polyester.

11 Claims, 1 Drawing Sheet

FIG. 1
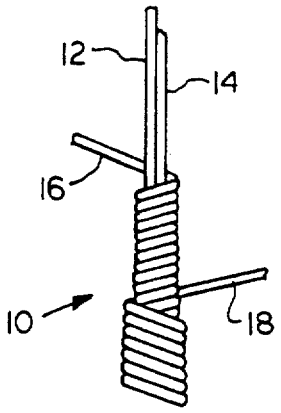
FIG. 2
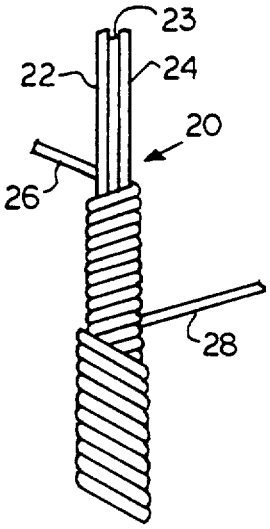
FIG. 3
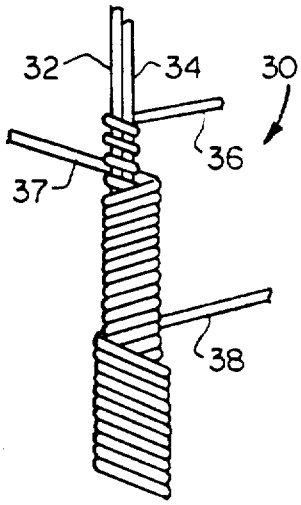
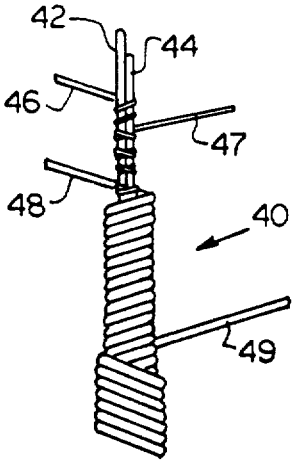
FIG. 4
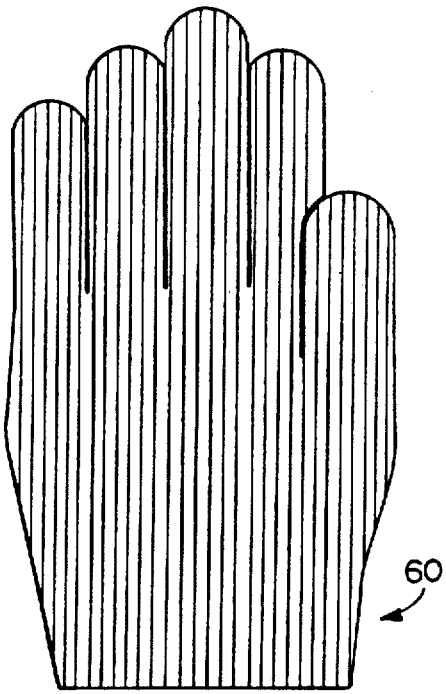
FIG. 6
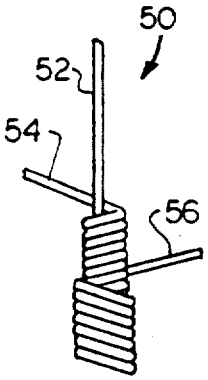
FIG. 5

YARN AND GLOVE

This application is a continuation of application Ser. No. 07/487,040 filed Mar. 2, 1990 now abandoned, which in turn is a continuation-in-part of our application Ser. No. 07/366,885, which was filed Jun. 13, 1989, and is now the subject of U.S. Pat. No. 4,936,085 issued Jun. 26, 1990.

BACKGROUND OF THE INVENTION

The present invention relates generally to yarns, fabrics and protective garments knitted of such yarns and, more particularly, to an improved yarn which may be knitted into an improved, more comfortable, more flexible protective garment such as a glove.

Prior to the present invention, technological developments of cut resistant yarns for protective garments have followed essentially a two-pronged approach. The first approach was in connection with the use of Kevlar, which is a Dupont trademark for an aramid fiber, with the Kevlar fiber to be used in yarns for protective garments. By way of example and not by way of limitation, aramid fibers have been used to form yarns, with the yarns thereafter knitted to make protective garments, including protective gloves, as exemplified by Byrnes U.S. Pat. No. 3,883,898. In addition to the aramid yarn, aramid fibers have been used in combination with other materials such as wire to form a protective garment, such as a protective glove, with an increased/or cut-resistance. Examples of this concept may be found in Byrnes U.S. Pat. No. 4,004,295 and Byrnes et al. U.S. Pat. No. 4,384,449. This latter-most Byrnes patent describes a particular yarn configuration, namely, a four-piece yarn configuration including a core and a covering. The core is composed of two parallel strands, one wire and one aramid fiber, and the covering is composed of two strand spirally-wrapped around the core, one clockwise and one counterclockwise, both of aramid fiber. This approach was expanded upon in Bettcher U.S. Pat. No. 4,470,251 where the yarn is made up of five pieces; three parallel strands comprising the core, and two wrappings comprising the cover. The Bettcher patent generally describes the core as comprising two wires and one aramid fiber, and the two wrappings with the first, or inner wrapping, being a high-strength synthetic fiber such as aramid and an outer wrapping preferably comprising three strands of nylon. This Bettcher patent further describes yet another version of the yarn, namely, a seven piece yarn with generally the same core as the five piece yarn. The first wrapping (closest to the core) is preferably an aramid. The next outermost wrapping is also an aramid, the next outermost wrapping is a three strand nylon, and the outermost wrapping is a three strand nylon.

Applicant is the owner of previously issued U.S. Pat. No(s). 4,777,789 and 4,838,017 and pending U.S. application Ser. No. 176,075, filed Mar. 31, 1988, which disclose the use of extended-chain polyethylene, such as the fiber manufactured by Allied-Signal, Inc., under the trademark Spectra in combination with other fibers and wire and in various configurations, for the purpose of an improved cut resistant or slash resistant yarn and garment. We explained the use of extended use polyethylene as avoiding numerous limitations and problems which occurred with the use of aramid fiber, such as, but not limited to, the fact that the polyethylene fiber has a substantially greater tensile strength than the comparable aramid fiber, the fact that polyethylene fiber is resistant to ultraviolet light and does not result in undesirable color change, as contrasted to aramid fiber, that the polyethylene fiber has increased abrasion resistance comparable to aramid, has only two-thirds of the density, has greater chemical resistance, and is inert, non-absorptive, non-allergenic and stable.

There are certain limitations when extended-chain polyethylene fibers are utilized in a yarn for a protective garment. One such limitation is that the extended-chain polyethylene fiber has an extremely limited heat resistance and, thus, when gloves knitted of yarns using extended-chain polyethylene are utilized, for example, in the food industry, the extended chain polyethylene fibers can not withstand the high temperature used for laundering and drying the gloves.

We overcame some but not all of these problems in a composite wire-fiber yarn and glove knitted therefrom, in the configuration described in our aforementioned U.S. Pat. No. 4,777,789, which illustrates various configurations of yarn in FIGS. 1, 2 and 5, the yarn including both wire and fiber, and we described how fibers, other than aramid and extended-chain polyethylene, may be used.

However, in many industries it is not desirable to utilize yarns and protective garments such as gloves which contain wire. As previously indicated, the wire may break and injure the hand of the wearer. In addition, gloves or garments made of yarn which contains wire will be electrically conductive, which is unsuitable for certain purposes. Wire, of course, is also thermally conductive.

Thus the yarns containing wire and either extended-chain polyethylenes, or aramids, have numerous limitations.

SUMMARY OF THE INVENTION

The present invention relates to a new and improved yarn and protective garment, such as a glove, formed of the yarn. This invention is based on our discovery that a cut-resistant or slash resistant yarn suitable for industrial use, can now be made from fibers which are free of wire, and preferably free of extended-chain polyethylene and preferably free of aramid, while providing substantially the same cut resistance or slash resistance as the yarns and protective garments described in our prior applications and in the prior art referred to above.

The yarn and glove, according to the present invention, have numerous advantages over the prior art yarns and gloves as heretofore described, while maintaining substantial cut resistance and slash resistance, and the yarn, according to the present invention, may be formed on a conventional covering machine, may be utilized in conventional knitting or weaving machines and is of substantially lower cost than yarns which include wire.

BRIEF DESCRIPTION OF THE DRAWINGS

The various benefits and advantages of the present invention will be more apparent upon reading the following detailed description of the invention taken in conjunction with the drawings.

In the drawings, wherein like reference numerals identify corresponding components:

FIGS. 1 through 5 are illustrations of yarns in accordance with the principles of the present invention; and FIG. 6 is an illustration of a protective garment, namely, a glove, made from a yarn according to the principles of the present invention.

DETAILED DESCRIPTION OF THE INVENTION

Referring first to FIG. 1, a yarn 10 is illustrated according to the principles of the present invention, the yarn including a core and a covering. The core is illustrated as having two strands 12, 14. The strands are illustrated as being placed parallel to each other, although it is within the spirit of the present invention that the core strands may be wrapped, twisted or braided together. The core strands include a first fiber strand 12 and a second fiber strand 14. The core strand 12 may be formed of fiberglass, and the core strand 14 may be formed of fiberglass, nylon, polyester, polycotton, asbestos, wool or regular (i.e., non-extended chain) polyethylene, extended chain polyethylene or aramid. It is important that the core be non-metallic.

Surrounding the core is a covering comprising first and second strands 16, 18, wrapped in opposite directions relative to each other around the core. The covering strands may likewise be of fiberglass, nylon, polycotton, asbestos, wool, regular polyethylene, extended chain polyethylene, aramid or polyester. Again the covering should be non-metallic.

With respect to the details of the fibers, the fiberglass may be either E-glass or S-glass, either continuous filament or spun and having a denier between about 300 and about 2,000. Fiberglass fibers of this type are manufactured both by Corning and by PPG and are characterized by various properties such as relatively high tenacity, of about 12 to about 20 grams per denier, and by resistance to most acids and alkalies, by being unaffected by bleaches and solvents, and by resistance to environmental conditions such as mildew and sunlight and highly resistant to abrasion and to aging.

The fiber strand which is not made of fiberglass fiber may be nylon 6 or nylon 6,6 or polyester or one of the other fibers referred to above. The preferred denier range may be from about 400 to about 1,500 and the fiber may be filament or spun. Preferably, when nylon is used, it will be a preshrunk or low-shrink nylon. When a polyester fiber is utilized, it is characterized by good resistance to most acids except sulfuric acid and good resistance to alkalies except strong alkalies at boiling temperature. Furthermore, polyester exhibits excellent resistance to bleaches and solvents and excellent resistance to mildew, aging and abrasion. Polyester has good resistance to sunlight, but prolonged exposure to sunlight may cause some loss in strength. Nylon, of course, resists weak acids but is degraded by strong oxidizing agents, and nylon is substantially inert in alkalies, nylon generally can be bleached and dyed, and has excellent resistance to mildew, aging and abrasion. Nylon has good resistance to sunlight, although prolonged exposure to sunlight can cause some deterioration. When extended-chain polyethylenes or aramids are used they should preferably have the denier ranges and other details as set forth in the aforementioned prior applications.

At this point, it may be helpful to explain some of the benefits of the yarn heretofore described when compared to the yarn of the prior art. By prior art, we are referring to the metallic yarns as described previously in this patent application and in the prior art referred to herein, and as heretofore commercialized for use in cut resistant gloves or cut resistant garments.

A glove, knitted of the yarn of the present invention, which is free of wire, has equivalent cut resistance to a prior art glove knitted of a yarn of wire and aramid of the same total denier. The glove of the present invention has at least equivalent cut resistance to gloves including wire and extended chain polyethylene of the same total denier.

There are several additional benefits of the glove knitted from the yarn of the present invention as compared to gloves made of a yarn comprising aramid and wire and a glove made of a yarn comprising extended-chain polyethylene and wire. For example, wire tends to kink or knuckle and fracture during knitting and during laundering. In addition, when a glove containing wire is slashed with a knife, the wire can be nicked or cut, thus, creating additional wire ends. All of these wire ends can scratch or puncture the skin of the wearer of the glove. If the wire breaks prior to or during the knitting, there can be jamming of the knitting equipment and the resulting waste of yarn and partially-knitted gloves.

The yarn, according to the principles of the present invention, being free of wire, does not have the aforementioned problems, and, in addition, the yarn is softer for the hand, providing better feel and control for the wearer of a glove knitted from such a yarn and is more pliable in the knitting machines.

According to the principles of the present invention, a preferred fiberglass heretofore used is E-glass with a denier of about 650 in the core. The preferred range of denier of the fiberglass is from about 300 to about 2000.

Referring next to FIG. 2, a yarn 20 is illustrated comprising a core and covering. The core is illustrated as comprising three strands 22, 23, 24, which may be parallel, braided or twisted. At least one of the strands is preferably formed of fiberglass. Each of the other two strands may be fiberglass, nylon, polyester or other fiber as heretofore described. The covering for the core includes at least two strands 26, 28, wrapped about the core in opposite directions relative to each other such as a first wrap in a clockwise direction and a second wrap in a counterclockwise direction. The covering strands 26, 28 may be fiberglass, nylon or polyester, or any of the other fibers referred to above. Thus, for the purposes of comparison, the yarn of FIG. 1 may be thought of as comprised of four pieces or four plies or four ends while the yarn of FIG. 2 may be thought of as including five pieces or five plies.

Referring next to FIG. 3, yet another form of the yarn of the present invention is illustrated, this also being a five piece or five ply yarn 30. The yarn 30 includes a core and a covering, the core including two strands 32, 34, at least one of which is fiberglass, and the covering including three strands 36, 37 and 38, two of which are wrapped in the same direction around the core, and the third being wrapped around the core in a direction opposite to the other covering strands. Thus, for the purpose of illustration, the covering comprising strands 36, 37 and 38 includes an innermost covering strand 36 wrapped in a first direction about the core, a second covering strand 37 wrapped around both the core and the first covering strand 36, in a direction opposite to the direction of covering strand 36, and an outermost covering strand 38, wrapped about the covering strand 37 in a direction opposite to the direction of wrapping of covering strand 37 and identical to the direction of the wrapping of covering strand 36.

Referring next to FIG. 4, a yarn 40 is illustrated as a six piece or six ply yarn. The yarn 40 includes a core and a covering, the core including two strands 42, 44, at least one of which is fiberglass, and the covering including four strands 46, 47, 48 and 49. The covering strands are wrapped about the core, the covering strands are sequentially applied to the core, and each strand is wrapped in the direction opposite to the direction of the immediately preceding cover strand. Thus, in the illustrated embodiment, a first covering strand 46 is wrapped in a first direction about the core, a second covering strand 47 is wrapped about the core in a direction opposite to the direction of the wrapping of cover strand 46, and, of course, covering strand 47 is also wrapped around portions of the covering strand 46. Thereafter, a third covering strand 48 is wrapped around the core in the same direction as covering strand 46 and the third covering strand 48 will, of course, cover not only the core but also covering strands 46 and 47. Lastly, a fourth covering strand 49 is wrapped about the core in the direction opposite to the direction of wrap of covering strand 48 and, hence, in the same direction of wrap as covering strand 47. Covering strand 49 is the outermost wrap and therefore encircles not only the core but all the preceding covering strands.

Referring next to FIG. 5, a three-piece or three ply yarn 50 is disclosed having a single strand 52 as a core and two covering strands 54, 56 wrapped in opposite directions, relative to each other, about the core. In the embodiment of FIG. 5, the core strand will be fiberglass and the covering strands may be any one or more of the fibers referred to above.

The yarn, according to the principles of the present invention, may be formed on a standard hollow spindle covering machine with the coverings or wrappings being at the rate of 4–12 turns per inch, with 8 turns per inch being preferred. The yarn according to any of the embodiments of the present invention may be knit into a glove 60 on a conventional knitting machine such as, but not limited to, a Shima Seiki machine. The cut resistant yarn of the present invention may also be woven or knitted to form other protective garments.

The fibers used in the yarn of the present invention should typically have a denier in the range of about 185 to about 2000, with a range of 375 to about 1000 being preferred for the core and a range of 500 to 1000 being preferred for the covering. By way of comparison, if a four ply yarn is provided according to the principles of the present invention, the two core strands may each have a denier of about 650 and the two covering strands may each have a denier of about 1000. Thus the denier of the composite yarn is just over 3500 since denier are not additive because of the wrapping of the covering on the core. A glove knitted of such a yarn has equivalent cut resistance to a yarn made of a core and covering, the core including wire of about 0.0045 inch diameter and a fiber of aramid or extended chain polyethylene and the covering including two wrappings of nylon or extended chain polyethylene or aramid, or combinations thereof, with an equivalent total denier. The preferred total denier of the yarn should generally be in the range of about 2000 to about 5000.

For ease of reference it is pointed out that fibers such as fiberglass, aramids and extended chain polyethylene typically have a tenacity greater than 10 grams per denier while the other fibers referred to herein have a tenacity less than 10 grams per denier.

A preferred yarn for a glove according to the principles of the present invention would have a two strand core, one strand of which would be fiberglass and the other of which would be extended chain polyethylene, and a two wrap cover. The inner cover wrap would preferably be extended chain polyethylene and the outer cover wrap would be polyester. At present, extended chain polyethylene is available in 650 and 1200 denier. It should be appreciated that each fiber could be either filament or yarn according to the present invention.

The foregoing is a complete description of the present invention. Various changes and modifications may be made without departing from the spirit and scope of the invention and, hence, the invention should be limited only by the following claims.

What is claimed is:

1. A non-metallic composite cut-resistant yarn for use in making strong flexible cut-resistant products comprising:

(a) a non-metallic core including at least one strand of fiberglass, said at least one strand having a denier in the range of 375–1,000 and being substantially parallel to and untwisted with another strand in said core;

(b) a non-metallic covering wrapped on said core, said covering including at least tow strands unbraided and spirally wrapped in opposite directions relative to each other around the core, said composite cut-resistant yarn having a composite denier between about 2,000 and about 5,000;

(c) said two strands in said covering being spirally wrapped about said core at the rate of 8–12 turns per inch;

whereby said composite yarn may be formed into fabric on conventional knitting or weaving machines.

2. The non-metallic yarn as defined in claim 1 wherein at least one of the covering strands is selected from the group consisting of nylon, polycotton, polyester, aramid, extended-chain polyethylene and polyester.

3. The non-metallic yarn as defined in claim 1 wherein at least one of the covering strands has a tenacity greater than about 10 grams per denier.

4. The non-metallic yarn as defined in claim 1 wherein all of the covering strands have a tenacity of less than about 10 grams per denier.

5. The non-metallic yarn as defined in claim 1 wherein said core includes at least two strands.

6. The non-metallic yarn as defined in claim 1 wherein said core includes at least two strands, at least one of said core strands having a tenacity greater than about 10 grams per denier.

7. The non-metallic yarn as defined in claim 1 wherein the core includes at least two strands each of which has a tenacity greater than about 10 grams per denier.

8. The non-metallic yarn as defined by claim 1 wherein the yarn is knitted to form a protective garment.

9. The non-metallic yarn as defined by claim 1 wherein the yarn is used to form a fabric.

10. The non-metallic yarn as defined by claim 1 wherein the yarn is to form a glove.

11. A composite, cut-resistant yarn for use in making strong, flexible products comprising:

(a) a non-metallic core including one strand of fiberglass having a denier in the range of 375–1,000 and another strand formed of an extended chain polyethylene;

(b) a non-metallic covering wrapped on said core, said covering including two fiber strands wrapped in opposite directions relative to each other around the core, one of said wrapping strands being formed of extended chain polyethylene and the other wrapping strand being formed of polyester, the composite cut-resistant yarn having a composite denier between about 2,000 and about 5,000;

(c) said two fiber strands being spirally wrapped about said core at the rate of 8–12 turns per inch;

(d) whereby said composite yarn may be formed into fabric on conventional knitting or weaving machines.

* * * * *

US005177948A

REEXAMINATION CERTIFICATE (2546th)

United States Patent [19]

[11] B1 5,177,948

Kolmes et al.

[45] Certificate Issued Apr. 18, 1995

[54] YARN AND GLOVE

[76] Inventors: Nathaniel H. Kolmes, 1740 5th St. Dr., NW., Hickory, N.C. 28601; Harold F. Plemmons, Rte. #1, Box #628, Millers Creek, N.C. 28651

Reexamination Request:
No. 90/003,347, Mar. 1, 1994

Reexamination Certificate for:

| | |
|---|---|
| Patent No.: | **5,177,948** |
| Issued: | **Jan. 12, 1993** |
| Appl. No.: | **823,088** |
| Filed: | **Jan. 15, 1992** |

Related U.S. Application Data

[63] Continuation of Ser. No. 487,040, Mar. 2, 1990, abandoned, continuation-in-part of Ser. No. 366,885, Jun. 13, 1989, Pat. No. 4,936,085.

[51] Int. Cl.[6] ..... D02G 3/18; D02G 3/38
[52] U.S. Cl. ..... 57/229; 57/230
[58] Field of Search ..... 57/210, 229, 230, 231, 57/232, 235, 902

[56] References Cited

U.S. PATENT DOCUMENTS

| | | | |
|---|---|---|---|
| 2,335,644 | 11/1943 | Camp | 57/234 X |
| 2,573,361 | 10/1951 | Rodgers et al. | 57/229 X |
| 3,490,224 | 1/1970 | Bourgeas | 57/244 X |
| 4,321,854 | 3/1982 | Foote et al. | 57/210 X |
| 4,384,449 | 5/1983 | Byrnes et al. | 57/210 |
| 4,470,251 | 9/1984 | Bettcher | 57/210 X |
| 4,651,514 | 3/1987 | Collett | 57/227 |
| 4,777,789 | 10/1988 | Kolmes et al. | 57/210 |
| 4,838,017 | 6/1989 | Kolmes et al. | 57/210 |
| 4,886,691 | 12/1989 | Wincklhofer | 428/68 |
| 4,936,085 | 6/1990 | Kolmes et al. | 57/229 |
| 4,967,548 | 11/1990 | Fangeat et al. | 57/229 X |
| 5,119,512 | 6/1992 | Dunbar et al. | 2/167 |

FOREIGN PATENT DOCUMENTS

| | | |
|---|---|---|
| 0027708 | 10/1980 | European Pat. Off. . |
| 0050011 | 10/1981 | European Pat. Off. . |
| 0133205 | 6/1984 | European Pat. Off. . |
| 0168774 | 7/1985 | European Pat. Off. . |
| 7906321 | 3/1979 | Germany . |
| 8313102 | 6/1983 | Germany . |

OTHER PUBLICATIONS

A newsletter published by Allied Fibers, division of Allied Signal, Inc., Petersburg, Va., identified as: "Kaleidoscope," Issue 3, vol. III, Winter 1988; Attached here as Exhibit D.

*Primary Examiner*—Joseph J. Hail, III

[57] ABSTRACT

An improved non-metallic yarn, fabric and protective garment made from such yarn, where the yarn, fabric and garment exhibit increased cut resistance, flexibility, pliability and softness. The yarn is non-metallic and includes a core made of fiber and a covering wrapped around the core. At least one of the strands of the core is fiberglass, the non-fiberglass strands are preferably nylon, extended chain polyethylene, aramid or polyester.

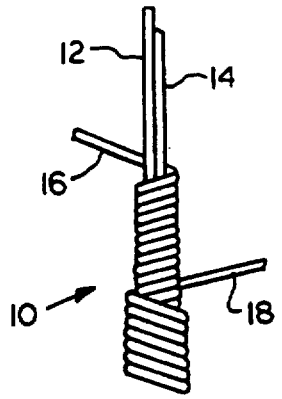

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–11 is confirmed.

New claim 12 is added and determined to be patentable.

*12. A non-metallic composite cut-resistant yarn for use in making strong, flexible, cut-resistant products comprising:*

*(a) a non-metallic core including at least one strand of fiberglass, said at least one strand having a denier in the range of 375-1,000 and being substantially parallel to and untwisted with a strand of extended chain polyethylene in said core;*

*(b) a non-metallic covering wrapped on said core, said covering including at least two strands unbraided and spirally wrapped in opposite directions relative to each other around the core, said composite cut-resistant yarn having a composite denier between about 2,000 and about 5,000;*

*(c) said two strands in said covering being spirally wrapped about said core at the rate of 8-12 turns per inch;*

*whereby said composite yarn may be formed into fabric on conventional knitting or weaving machines.*

* * * * *